US007736275B2

(12) United States Patent
Chuang et al.

(10) Patent No.: US 7,736,275 B2
(45) Date of Patent: Jun. 15, 2010

(54) WRIST EXERCISER WITH SOUND GENERATOR

(76) Inventors: Yun Yu Chuang, 4F, No. 16, Alley 15, Lane 82, Da Yong Street, San Chong City, Taipei 241 (TW); Ming Hung Lin, 2F, No. 24, Lane 178, Li Shyng Road Section 1, San Chong City, Taipei 241 (TW)

( * ) Notice: Subject to any disclaimer, the term of this patent is extended or adjusted under 35 U.S.C. 154(b) by 0 days.

(21) Appl. No.: 11/514,867

(22) Filed: Sep. 5, 2006

(65) Prior Publication Data

US 2008/0058166 A1 Mar. 6, 2008

(51) Int. Cl.
*A63B 23/14* (2006.01)
*A63H 1/00* (2006.01)
*A63H 1/20* (2006.01)

(52) U.S. Cl. ..... 482/44; 482/45; 446/233; 446/235

(58) Field of Classification Search ..... 482/44, 482/45, 136, 2, 49; 601/33, 23, 40; 446/233, 446/235, 252, 265; *A63B 5/00, 23/14; A63H 1/20*
See application file for complete search history.

(56) References Cited

U.S. PATENT DOCUMENTS 186,255 A * 1/1877 Jenkins ..... 446/215
2,177,878 A * 10/1939 Savage ..... 446/153
2,666,276 A * 1/1954 Huff ..... 446/235
2,786,302 A * 3/1957 Futterer ..... 446/215
2,836,009 A * 5/1958 Wang ..... 446/242
3,523,386 A * 8/1970 Brown ..... 446/233
3,745,697 A * 7/1973 Wang ..... 446/242
4,277,912 A * 7/1981 Hsien ..... 446/233
4,327,518 A * 5/1982 Knauff ..... 446/242
4,713,039 A * 12/1987 Wong ..... 446/233
5,083,799 A * 1/1992 Thill ..... 473/588
5,353,655 A * 10/1994 Mishler ..... 74/5 R
5,800,311 A * 9/1998 Chuang ..... 482/44
6,162,110 A * 12/2000 Szumowski ..... 446/255
6,764,371 B2 * 7/2004 Hartman et al. ..... 446/46
6,770,012 B2 * 8/2004 Kuo ..... 482/44
6,802,758 B2 * 10/2004 Somers ..... 446/242
7,077,786 B2 * 7/2006 Chuang et al. ..... 482/45
2002/0068663 A1 * 6/2002 Smith ..... 482/45
2002/0094749 A1 * 7/2002 Chung ..... 446/235

* cited by examiner

*Primary Examiner*—Loan H Thanh
*Assistant Examiner*—Sundhara M Ganesan
(74) *Attorney, Agent, or Firm*—Tim Tingkang Xia; Morris, Manning & Martin

(57) ABSTRACT

A wrist exercise includes a casing composed of upper and lower casing members mating each other to form a hollow sphere, a retention ring fixed between the upper and lower casing members, a rotor rotatably supported inside the casing by the retention ring. Cavities are formed in opposite sides of the rotor and are each divided into chambers by partitions fixed in the cavities. Holes are defined in an outside surface of the rotor and are in communication with the chambers, whereby, in operation of the wrist exerciser, the rotor is rotated and high-speed airflows are caused between the holes and the chambers due to centrifugal forces induced by the rotation of the rotor, which airflows generate sounds, thereby effecting sound generation of the wrist exerciser.

7 Claims, 10 Drawing Sheets

WRIST EXERCISER WITH SOUND GENERATOR

BACKGROUND OF THE INVENTION

1. Field of the Invention

The present invention generally relates to a wrist exerciser, and in particular to a separable casing structure of a wrist exerciser.

2. The Related Art

Wrist exercisers comprising a hollow casing inside which a spherical rotor is rotatably supported are known for exercising wrist-related muscles and rehabilitation purposes. Examples are shown in Taiwan Utility Model No. 135058 and U.S. Pat. No. 5,800,311, both disclosing a rotary exercising device for wrist, which is operated with simple rotation performed by wrist muscles.

The conventional wrist exercisers are of a single function of exercising or strengthening wrist-related muscles. Although improvements that combine lighting instruments to the wrist exercisers to induce lighting effect during the operation of the wrist exerciser are known, no audio effect for enhanced sound/lighting effect of entertainment can be performed with the operation of the conventional wrist exercisers. Adding circuit and additional electrical/mechanical elements to the wrist exerciser may induce sound and/or light during the operation of the wrist exercisers, but with the expense of complication of construction and increase of manufacturing costs. Further, the circuit must be powered by an internal or built-in power source, which often has very limited power capacity. Thus, watching out for running out of power is of particular concern for the wrist exerciser players. This is troublesome.

Thus, it is desired to have a wrist exerciser that overcomes the above discussed problems of the conventional devices.

SUMMARY OF THE INVENTION

An object of the present invention is to provide a sound-generating wrist exerciser comprising a rotor defining open chambers at opposite sides and also forming holes in an outer surface thereof and in communication with the chambers whereby airflows are caused between the holes and the chambers due to the centrifugal forces induced by the rotation of the rotor to thereby effecting sound generation.

Another object of the present invention is to provide a wrist exerciser that, when operated, generates sounds without any electrical circuit and thus consuming no electrical power.

To achieve the above objects, in accordance with the present invention, there is provided a wrist exercise comprising a casing composed of upper and lower casing members mating each other to form a hollow sphere, a retention ring fixed between the upper and lower casing members, a rotor rotatably supported inside the casing by the retention ring. Cavities are formed in opposite sides of the rotor and are each divided into chambers by partitions fixed in the cavities. Holes are defined in an outside surface of the rotor and are in communication with the chambers, whereby, in operation of the wrist exerciser, the rotor is rotated and high-speed airflows are caused between the holes and the chambers due to centrifugal forces induced by the rotation of the rotor, which airflows generate sounds, thereby effecting sound generation without circuit boards and without consumption of electrical power.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENTS

Figure 1:
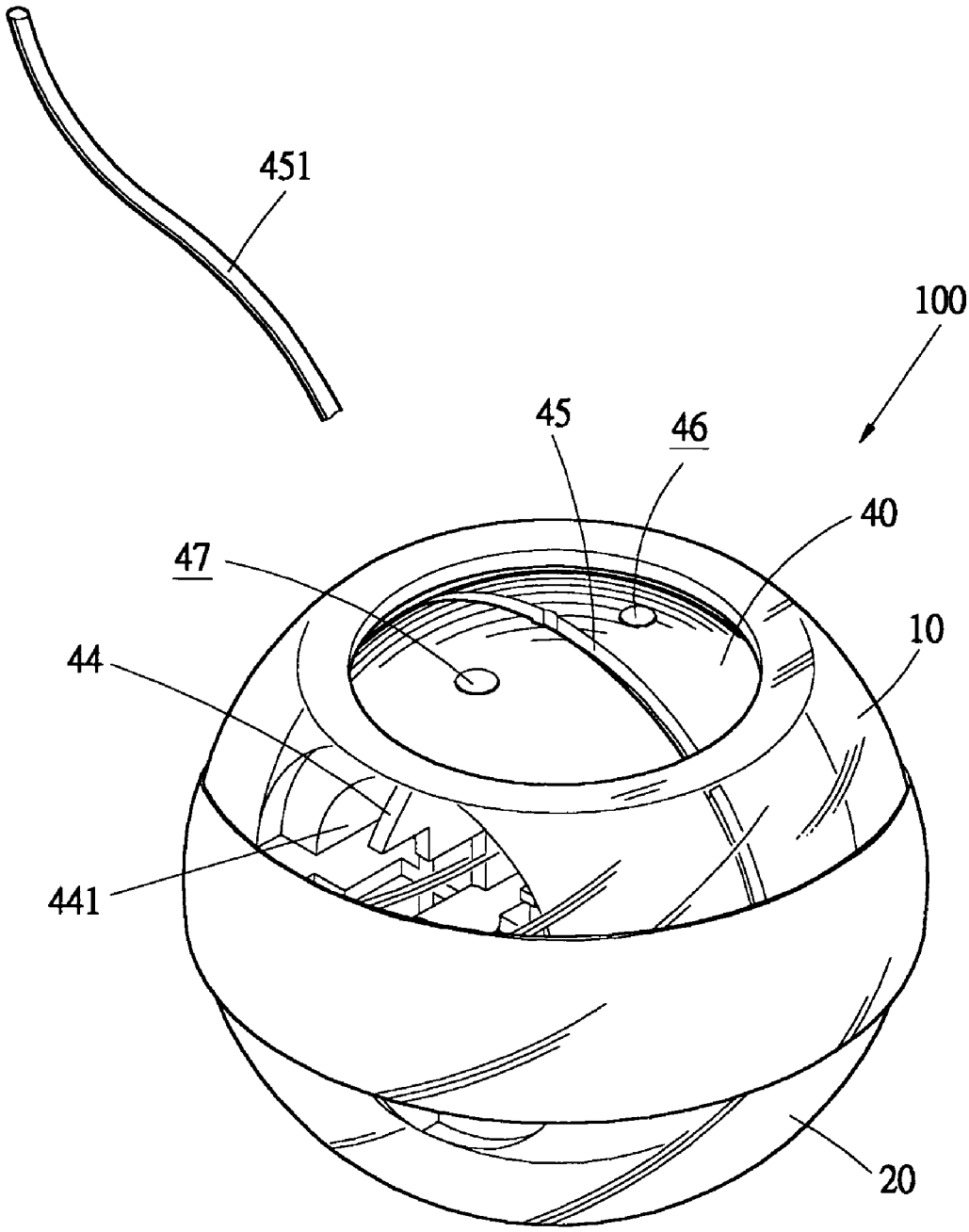
FIG. 1 is a perspective view of a wrist exerciser constructed in accordance with a first embodiment of the present invention.
Figure 2:
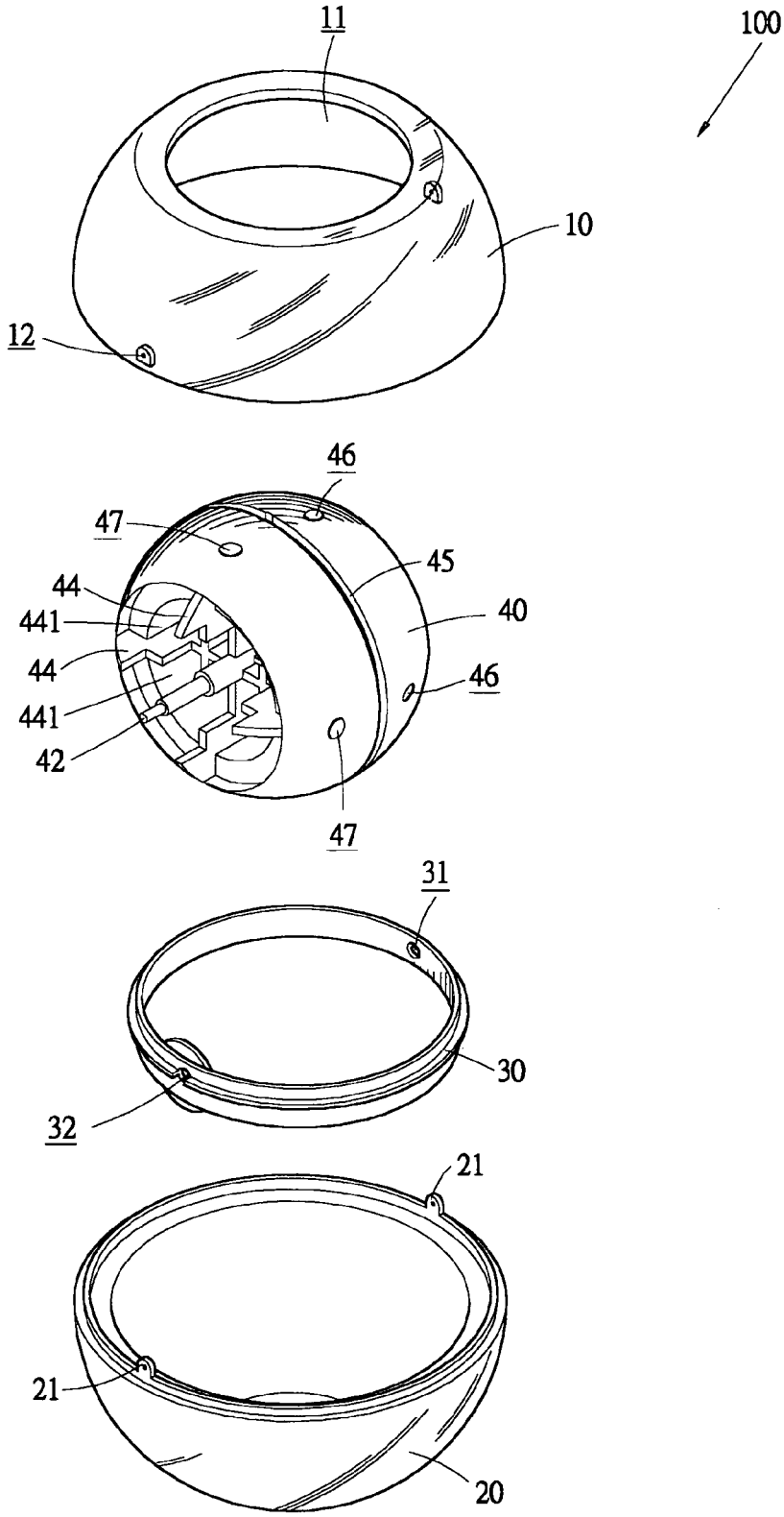
FIG. 2 is an exploded view of FIG. 1.
Figure 3:
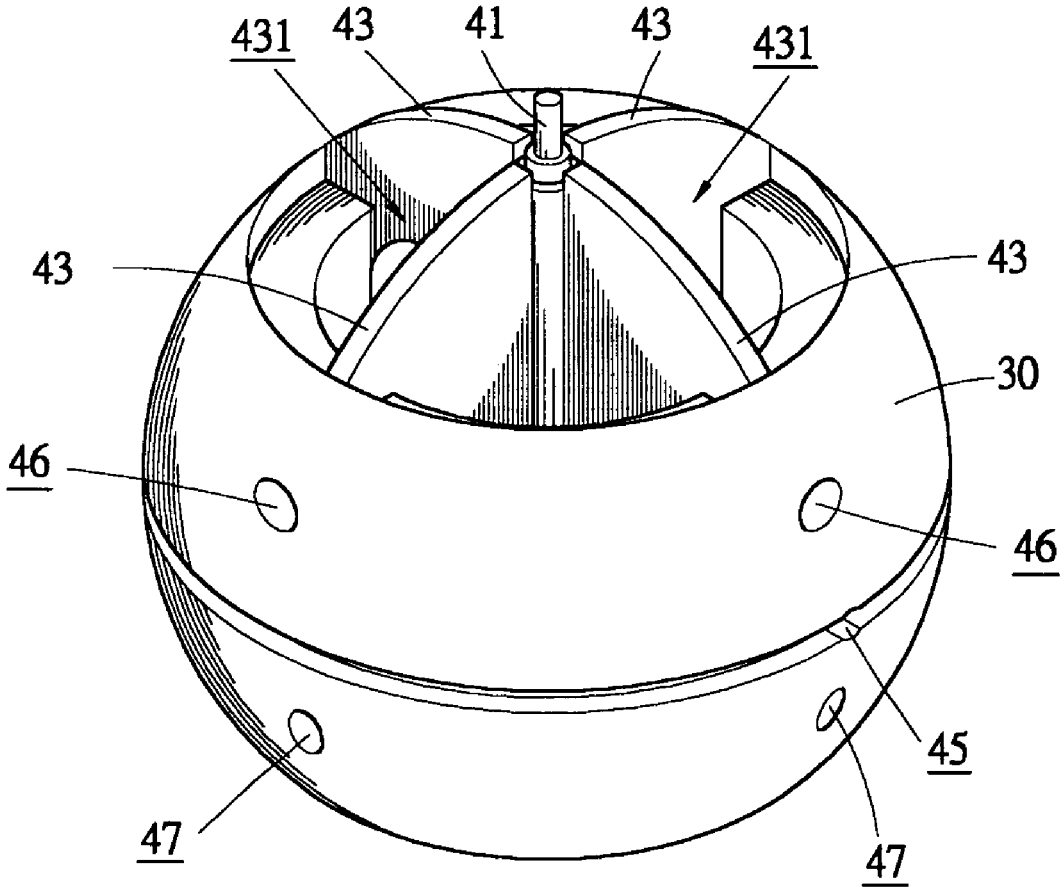
FIG. 3 is a perspective view of a rotor shown in FIG. 2 taken at different perspective.
Figure 4:
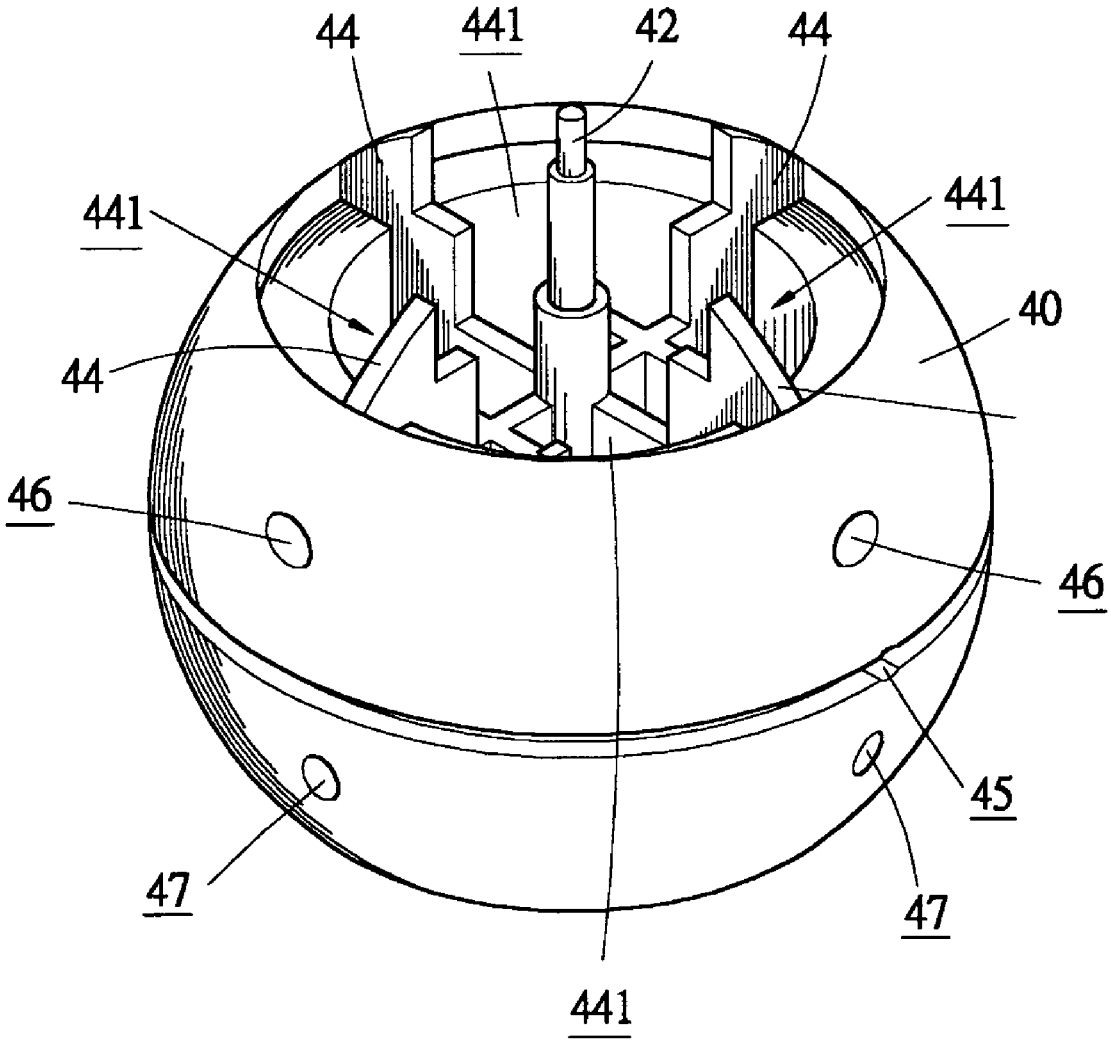
FIG. 4 is a perspective view of the rotor of FIG. 2 taken at a perspective opposite to FIG. 3.
Figure 5:
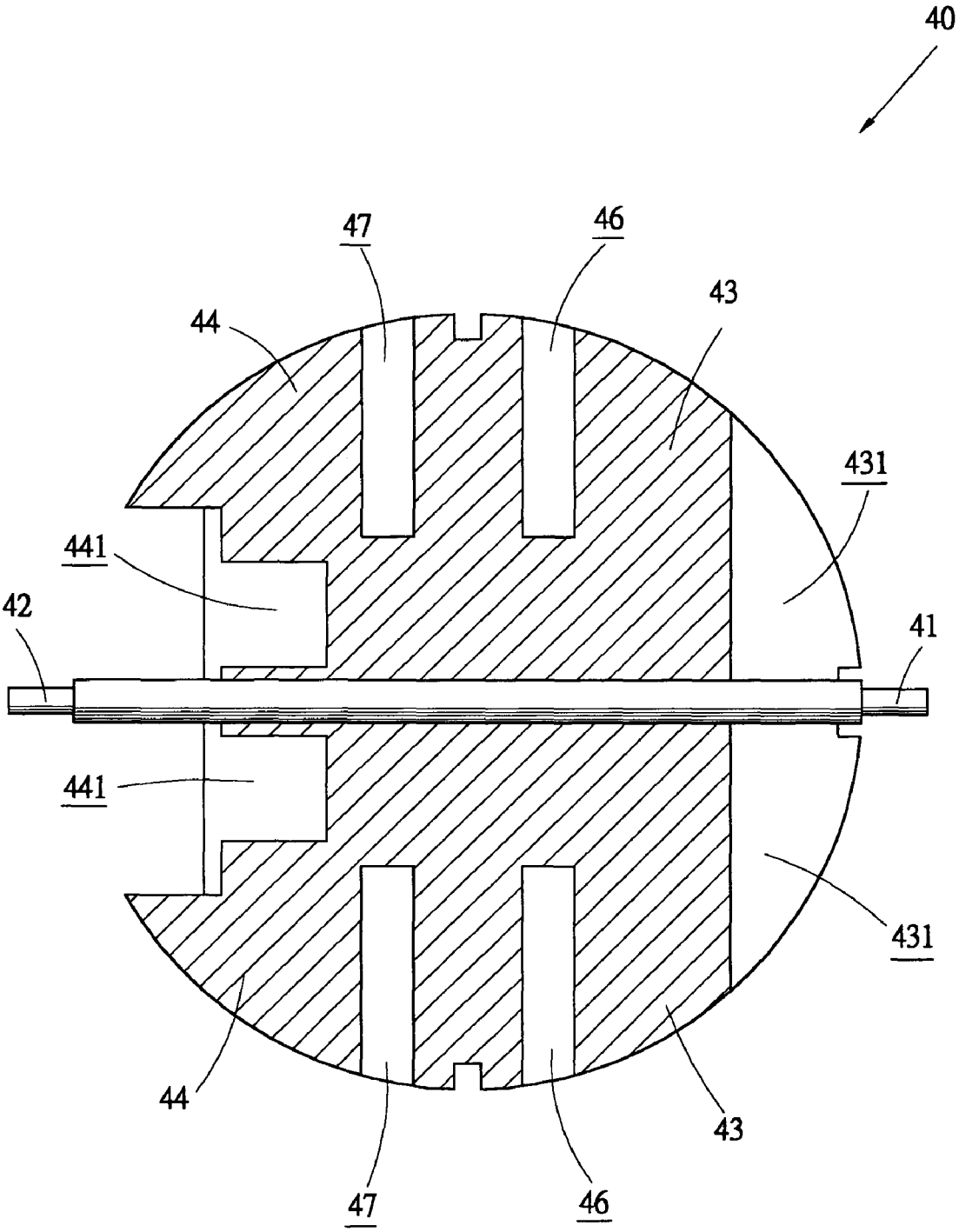
FIG. 5 is a cross-sectional view of the rotor of FIG. 2.

With reference to the drawings and in particular to FIGS. 1-5, a wrist exerciser constructed in accordance with a first embodiment of the present invention, generally designated with reference numeral 100, comprises a casing composed of upper and lower casing members 10, 20 both being hollow hemi-spheres mating each other along opposing mating edges to define an interior space (not labeled) therebetween. The upper casing member 10 defines a hole 11, substantially opposite to the lower casing member 20. Two apertures 12 and two corresponding perforated lug 21 are respectively formed in the upper and lower casing members 10, 20 for engaging and fixed to each other to thereby secure the upper and lower casing members 10, 20 together, forming a hollow sphere.

A retention ring 30 is interposed between the mating edges of the upper and lower casing members 10, 20. Holes 31, 32, which are diametrically opposite to each other, are defined in the retention ring 30. A rotor 40 is accommodated in the sphere composed of the upper and lower casing members 10, 20 and has axles 41, 42 that are coaxial with each other and extend in opposite directions. The axles 41, 42 are rotatably received in the holes 31, 32 of the retention ring whereby the rotor 40 is rotatable inside the spherical casing and between apertures 12 of the upper casing member 10 (or the apertures 21 of the lower casing member 20). Thus, the rotor 40 is rotatable about the axles 41, 42 and between the upper and lower casing members 10, 20.

The rotor 40 forms opposite cavities around the axles 41, 42. Partitions 43, 44 are arranged in the cavities and extending between the axles 41, 42 and inside circumferences of the cavities to thereby divide each cavity into a plurality of chambers 431, 441 (see FIGS. 3 and 4).

A circumferential groove 40 is formed along a circumference of the rotor 40 for receiving a wire 451 wound therein. The wire 451 is extended into the casing by having an end passing through the hole 11 of the upper casing member 10. By forcibly pulling the wire 451 outward through the hole 11, the wire 451 is unwound from the rotor 40 and cause initial rotation of the rotor 40 due to a driving force imparted on the rotor 40 by the friction between the rotor 40 and the wire 451. This is just one example of causing initial rotation of the rotor 40, and other means may also be employed to effect the initial rotation of the rotor 40 without departing from the scope of the present invention.

Holes 46, 47 are defined in an outer surface of the rotor 40. The holes 46, 47 can be distributed on the outer surface of the rotor 40 in any desired pattern. In the embodiment illustrated, the holes 46 and the holes 47 are respectively formed in rows in the casing members 10, 20 in a symmetric manner. The holes 46 are in communication with the chambers 431, while the holes 47 are in communication with the chamber 441, whereby when the rotor 40 rotates between the upper and lower casing members 10, 20, the centrifugal forces induced by the rotation of the rotor 40 causes high-speed airflows between the holes 46 and the chambers 431 and between the holes 47 and the chambers 441, which serves as a sound generator that induces sounds, just like a whistle.

Figure 6:
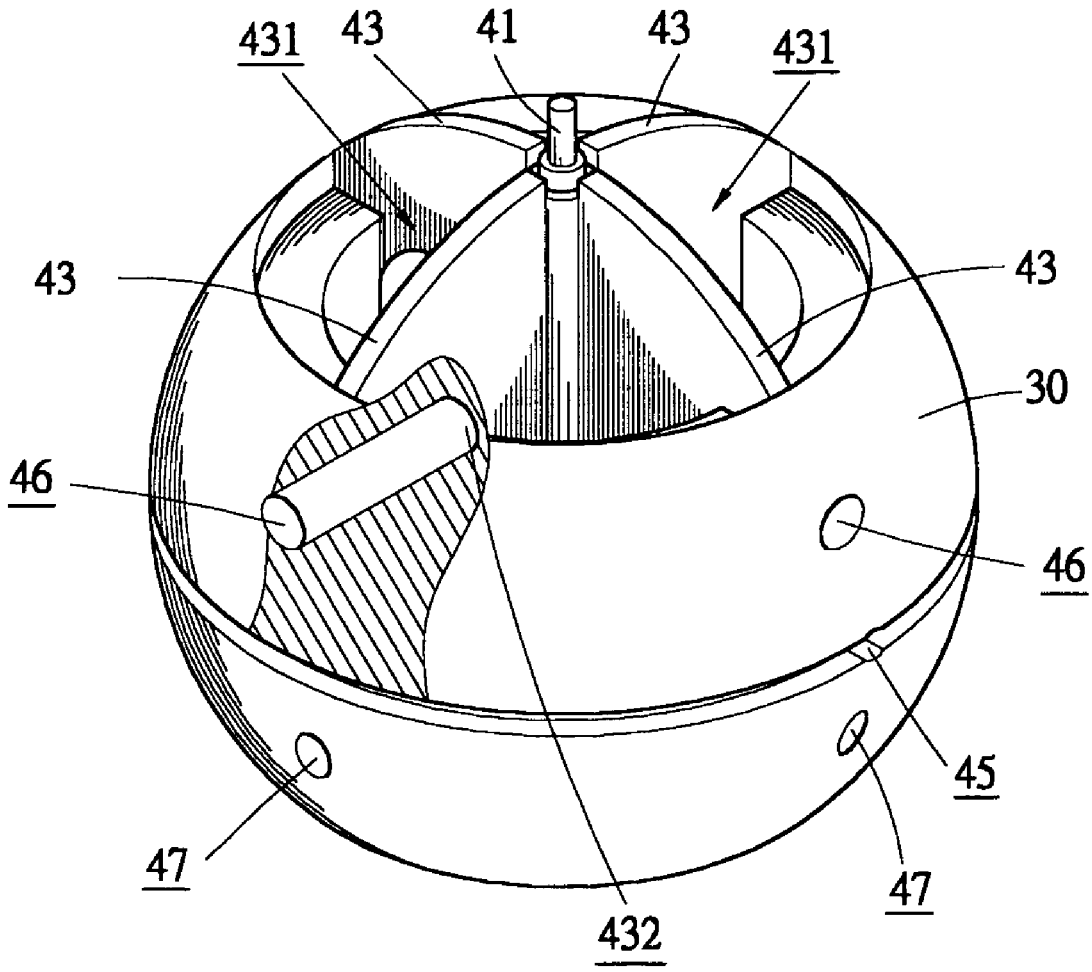
FIG. 6 is a rotor constructed in accordance with a second embodiment of the present invention.
Figure 7:
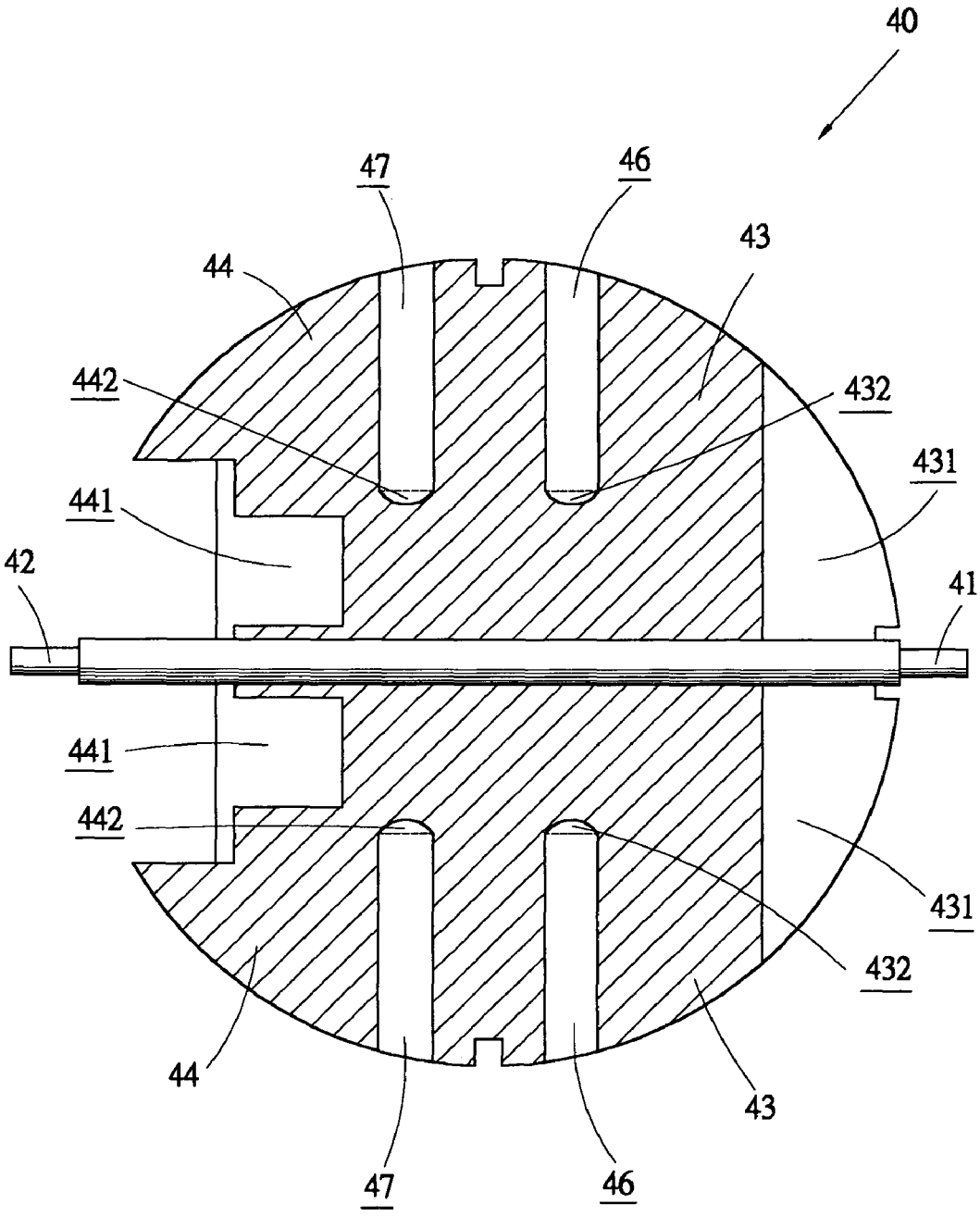
FIG. 7 is a cross-sectional view of the rotor shown in FIG. 6.

Referring now to FIGS. 6 and 7, which show a rotor constructed in accordance with a second embodiment of the present invention, each partition 43, 44 forms a notch 432, 442 in a lower edge thereof, corresponding to the holes 46, 47, whereby high-speed airflows that are caused between the holes 46 and the chambers 431 (and between the holes 47 and the chambers 441) due to the rotation of the rotor 40 can be of variable tune and sound level by means of the notches 432, 442. The notches 432, 442 can be of any desired shape and they are arc notches in the embodiment illustrated.

Figure 8:
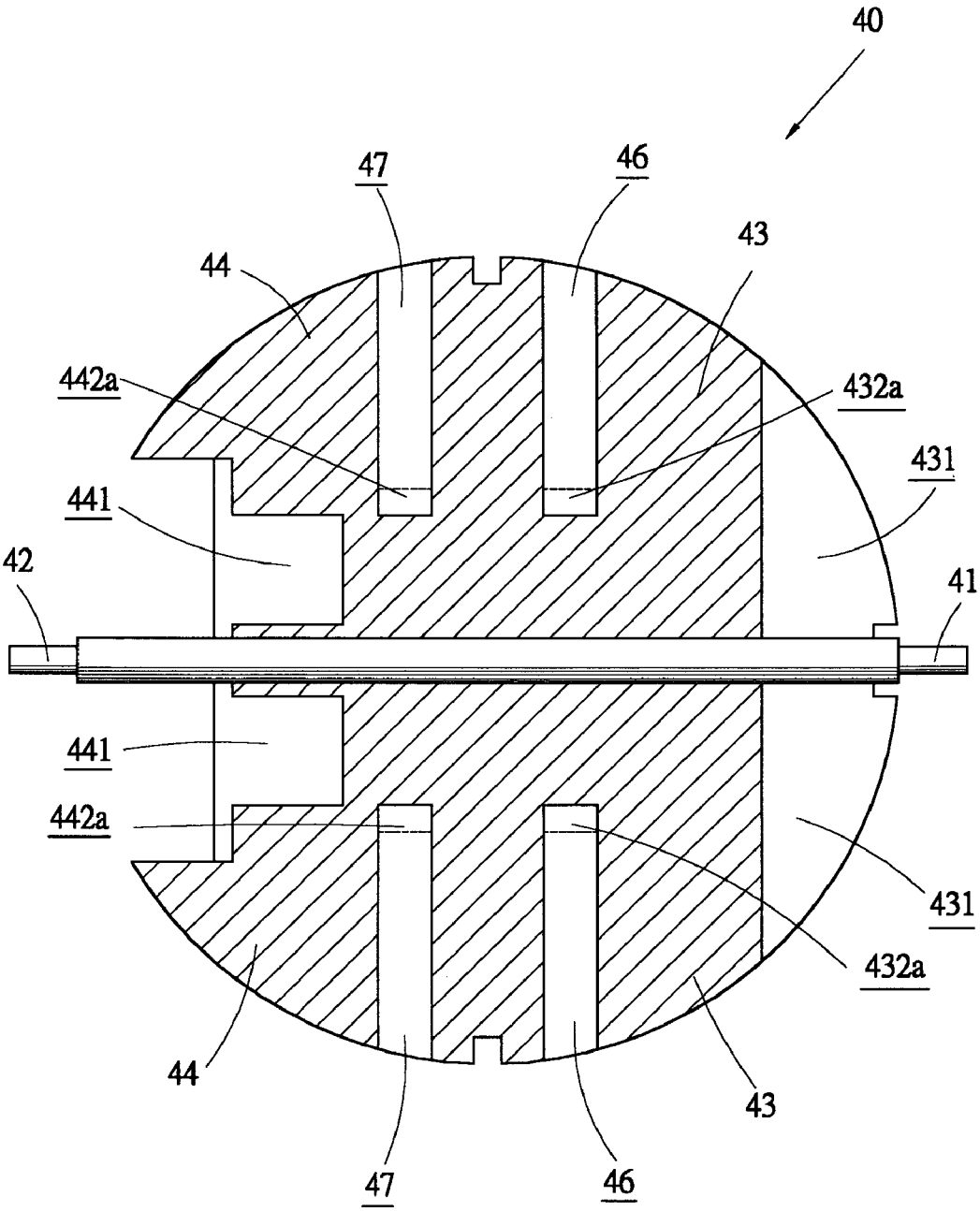
FIG. 8 is a cross-sectional view showing a rotor constructed in accordance with a third embodiment of the present invention.
Figure 9:
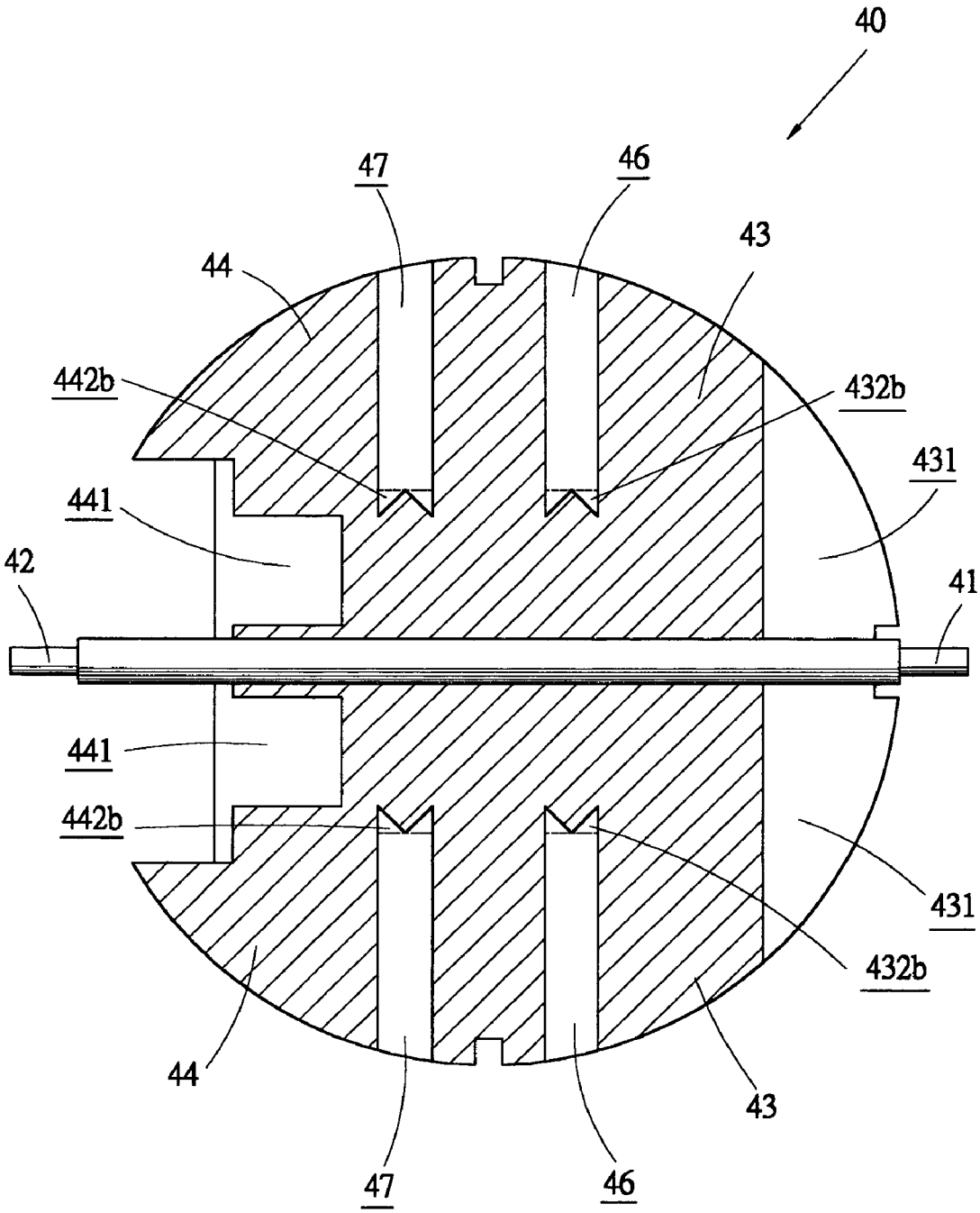
FIG. 9 is a cross-sectional view showing a rotor constructed in accordance with a fourth embodiment of the present invention.
Figure 10:
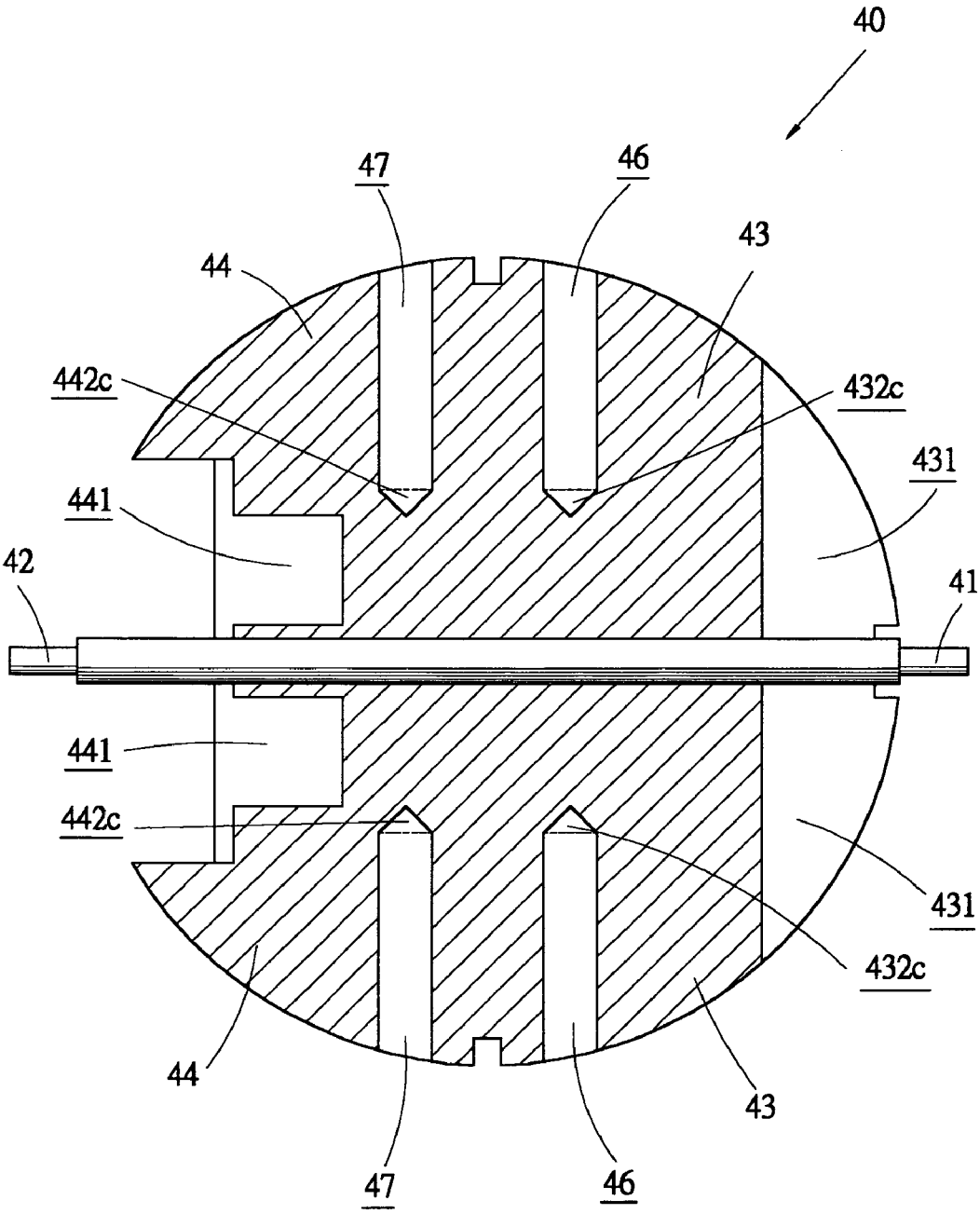
FIG. 10 is a cross-sectional view showing a rotor constructed in accordance with a fifth embodiment of the present invention.

FIGS. 8, 9, and 10 respectively show third, fourth, and fifth embodiments of the rotor 40. In the third embodiment illustrated in FIG. 8, the notches, which are designated with reference numeral 432*a*, 442*a*, are rectangular. In the fourth embodiment illustrated in FIG. 9, the notches, which are designated with reference numeral 432*b*, 442*b*, are of saw-toothed shape. In the fifth embodiment illustrated in FIG. 10, the notches, which are designated with reference numeral 432*c*, 442*c*, are triangular. The shapes of the notches 432, 442 (432*a*, 442*a*; 432*b*, 442*b*; 432*c*, 442*c*) allows the rotor 40 to generates sounds of different tunes and different sound levels.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A wrist exerciser, comprising:

a casing comprising upper and lower casing members matting each others to form a hollow sphere, the upper casing member forming a hole;

a retention ring interposed between the upper and lower casing members and defining opposite holes; and a rotor having oppositely-extending axles rotatably received in the holes of the retention ring and surrounding wall portions encircling the axles, a cavity being formed between each axle and a surrounding wall portion of the rotor with respective partitions extending therebetween to divide the cavity into a plurality of chambers, holes being defined in the rotor through the surrounding wall portions, the holes being offset from a diametric circumstance of the rotor about the axles to align and be in fluid communication with notches formed at respective edges of the partitions to be in fluid communication with the chambers, the surrounding wall portion of the rotor forming each of the holes directly contacting the wall portion of the partitions forming the notches;

whereby a whistling sound is generated during rotor rotation within the casing when said partitions are rotated to create airflow communicating between the notches and the chambers and passing through said holes being offset from a diametric circumstance of the rotor.

2. The wrist exerciser as claimed in claim 1, wherein the upper casing member forms aperture and the lower casing member forms perforated lugs.

3. The wrist exerciser as claimed in claim 1, wherein the rotor forms a circumferential groove between the surrounding wall portions.

4. The wrist exerciser as claimed in claim 1, wherein the notches are arc-shaped.

5. The wrist exerciser as claimed in claim 1, wherein the notches are rectangular.

6. The wrist exerciser as claimed in claim 1, wherein the notches are saw-tooth-shaped.

7. The wrist exerciser as claimed in claim 1, wherein the notches are triangular.

* * * * *